United States Patent [19]

Sanford et al.

[11] Patent Number: 4,581,509

[45] Date of Patent: Apr. 8, 1986

[54] FEATURES OF A CONDITION RESPONSIVE SWITCH

[75] Inventors: Carlton E. Sanford, East Providence, R.I.; Paul A. Lesser, N. Attleboro, Mass.

[73] Assignee: Texas Instruments Incorporated, Dallas, Tex.

[21] Appl. No.: 633,158

[22] Filed: Jul. 20, 1984

[51] Int. Cl.[4] ..... H01H 35/34

[52] U.S. Cl. ..... 200/83 P; 200/302.1; 337/343

[58] Field of Search ..... 337/343; 200/83 R, 83 J, 200/83 L, 83 P, 83 W, 302, 81 R, 81.9 R

[56] References Cited

U.S. PATENT DOCUMENTS

| | | | |
|---|---|---|---|
| 4,220,836 | 9/1980 | Hersey | 200/83 P |
| 4,243,858 | 1/1981 | Place | 200/83 P |
| 4,342,887 | 8/1982 | Sanford | 200/83 P |
| 4,459,444 | 7/1984 | Charboneau | 200/83 P |

FOREIGN PATENT DOCUMENTS

| | | | |
|---|---|---|---|
| 884686 | 12/1961 | United Kingdom | 200/83 P |

*Primary Examiner*—G. P. Tolin

*Attorney, Agent, or Firm*—John A. Haug; James P. McAndrews; Melvin Sharp

[57] ABSTRACT

A thermal or pressure responsive switch has a base mounting a set of electrical contacts. A metallic snap acting disc support, placed on the base is provided with a bore which receives a pin to transfer motion from a disc mounted on the support to the set of electrical contacts upon snapping of the disc.

A first embodiment has a pressure converter received on the disc support. The peripheral edge of the snap acting disc is received on a seat formed in the converter with an annular reaction ridge formed on the support.

A second embodiment has a pressure converter with the peripheral edge of the snap acting disc received on a seat formed in the disc support and an annular force ridge on the converter is adapted to contact the upper surface of the disc. In either embodiment a layer of low friction plastic can be placed on both faces of the disc.

A third embodiment has a flat metallic disc support with a recessed portion for receiving the disc and a continuous stop surface.

In all embodiments a cup shaped shell has a gasket received in a channel formed in a top end wall of the shell with the outer wall portion of the shell crimped over to compress the gasket and provide a gas tight seal.

The top end wall of the shell can be formed with a portion displaced from the wall to serve as an automatic valve deflator which can be used with any of the embodiments.

9 Claims, 7 Drawing Figures

FEATURES OF A CONDITION RESPONSIVE SWITCH

BACKGROUND OF THE INVENTION

This invention relates generally to electrical switches and more particularly to switches using snap acting disc elements which move between opposite convex and concave configurations and which are actuated upon the occurrence of selected conditions such as pressure or temperature.

Conventional condition responsive switches have a contact arm movable between first and second switch positions prebiased to one switch position and have a dished snap acting disc element movable between opposite convex and concave configurations for moving the switch between switch positions in responsive to the occurrence of selected temperature or pressure conditions. Such switches are intended to perform selected control functions in response to the occurrence of the selected temperature or pressure in a zone to be monitored.

In automobiles there are a number of different applications requiring such switches however the specific conditions vary significantly in some cases thereby requiring different switch characteristics. In certain applications, such as when monitoring compressor pressures a reliable seal which will prevent loss of freon for an indefinite period of time is important as well as having a switch which will perform the selected control function as intended. In certain applications the outside dimensional characteristics of the housing is critical. That is when received in a compressor well, the outer dimensions of the switch after final assembly must be very closely controlled with no bulging of the housing due to assembly techniques being permitted. Even the switch components need to be changed to some extent in order to meet various switching requirements. That is, when it is intended to monitor high pressures, a pressure converter may be required to convert pressure exposed to a diaphragm to a selected force level applied to the snap acting disc. In other applications in which a lower pressure is monitored the pressure converter is not always required. Another characteristic which can vary from one application to another is whether the disc is used to provide contact closure force or contact open force.

While the many requirements noted above can be met by conventional switches their use is limited by various factors such as undesirable variations in thermal or pressure response characteristics due to problems with seating of the disc or limiting overtravel of the disc without causing deleterious effects on the disc calibration. Other limitations include inconsistent and unreliable seals for pressure responsive switches and high costs due, inter alia, to low volume production in order to serve segmented functional needs.

SUMMARY OF THE INVENTION

It is an object of this invention to provide a novel and improved condition responsive switch; to provide such a switch having components which are easily and inexpensively manufactured and assembled for providing the switches with consistent and reliable condition response characteristics; to provide such a switch utilizing a dished disc element which is movable between convex and concave configurations with snap action in response to the occurrence of selected pressure or temperature conditions in which overtravel of the disc can be limited without deleteriously affecting the calibration of the disc and in which the disc is provided with an improved seat for longer life in which the calibration of the disc is maintained within narrow limits; and to provide such a novel and improved switch which is of simple, rugged and inexpensive construction.

Briefly, in accordance with the invention the novel and improved condition responsive electrical switch comprises a base of electrically insulative material formed with a side wall to define a switch cavity in which is mounted either a normally open or a normally closed set of electrical contacts. A metallic disc support and motion transfer pin guide member is placed on top of the side wall. A motion transfer pin is received in a bore formed in the disc support and pin guide member to transfer motion from a snap acting disc element mounted on the disc support and pin guide member to the set of electrical contacts upon snapping of the disc element.

According to a first embodiment of the invention the switch includes a pressure converter which is received on the disc support and pin guide member and is guided for sliding movement by an upstanding wall of the member. The peripheral edge of the snap acting disc is received on a seat formed in the converter with the lower surface of the disc contacting an annular reaction ridge formed on the support and guide member.

According to a second embodiment of the invention the switch includes a pressure converter also received on the disc support and pin guide member but with the peripheral edge of the snap acting disc received on a seat formed in the disc element support and pin guide member and an annular force ridge formed on the converter is adapted to contact the upper surface of the disc element. in either embodiment a layer of low friction plastic material can be placed on either or both sides of the disc element in order to provide consistent calibration of the switch.

According to a third embodiment of the invention the switch includes a flat metallic disc support with a recessed portion for receiving the disc element and a continuous stop surface for preventing overtravel of the disc.

In all of the embodiments a cup shaped shell has a gasket received in a channel formed in a top end wall of the shell with the outer wall portion of the shell crimped over, either continuously or in castellated fashion, to compress the gasket and provide a gas tight seal.

According to another feature of the invention, the top end wall of the shell can be formed with a portion lanced and displaced a selected distance from the wall to serve as an automatic valve deflator.

By means of the invention a variety of switch types is provided utilizing many common component parts, such as the base, shell, diaphragm and sealing gasket to achieve advantageous manufacturing economies.

BRIEF DESCRIPTION OF THE DRAWINGS

Other objects, advantages and details of the condition responsive device of this invention appear in the following detailed description of preferred embodiments of the invention, the detailed description referring to the drawings in which.

Figure 1:
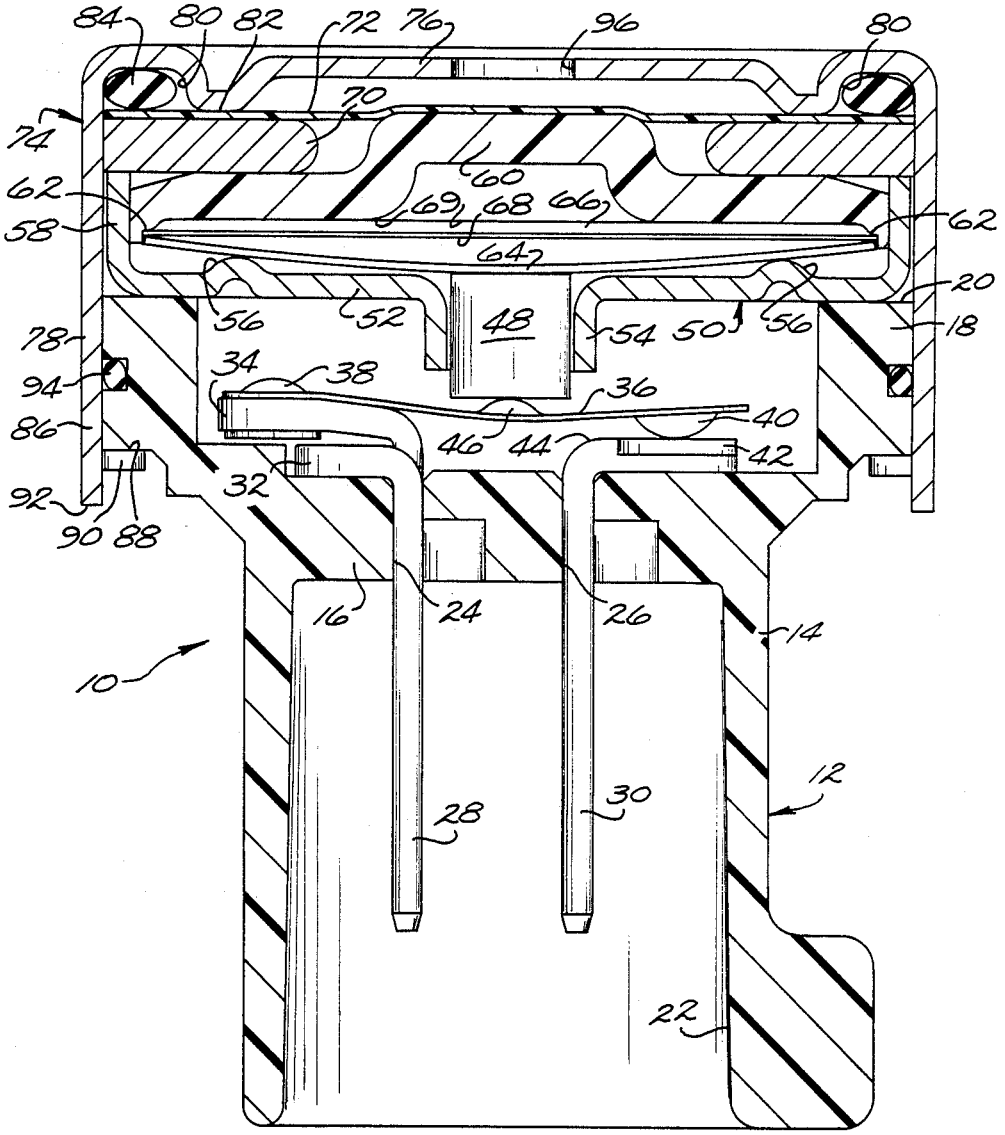
FIG. 1 is a sectional view along the longitudinal axis of a normally closed switch made in accordance with a first embodiment of this invention.

Dimensions of certain of the parts as shown in the drawings may have been modified to illustrate the invention with more clarity.

Corresponding reference characters indicate corresponding parts throughout the several views of the drawings.

DESCRIPTION OF PREFERRED EMBODIMENTS

Figure 2:
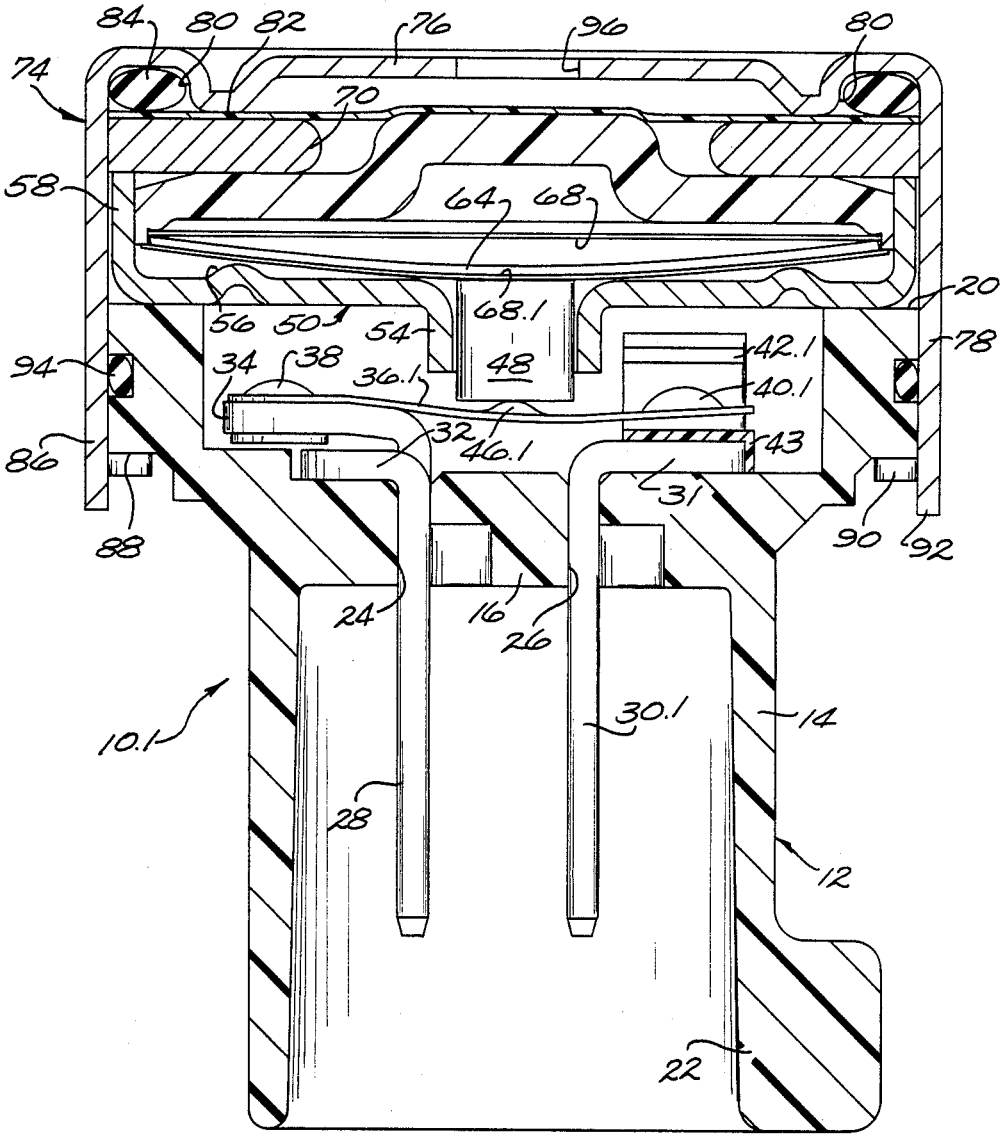
FIG. 2 is a sectional view to FIG. 1 of a normally open switch otherwise the same as the switch shown in FIG. 1.

Referring to the drawings, numeral 10 in FIGS. 1 and 2 indicates a condition responsive device of this invention which includes a base 12 preferably molded in one piece using a suitable rigid electrically insulative material such as glass filled nylon or the like. The base preferably has a cylindrical configuration including a cylindrical intermediate part 14, a bottom wall 16 and cylindrical side wall 18 which has a flat distal mounting surface 20. Intermediate part 14 is formed with a bore 22 to form a terminal enclosure. Bottom wall 16 is provided with first and second apertures 24 and 26 and receive therethrough terminals members 28 and 30 respectively. Terminal 28 has a shelf 32 received on wall 16 and a platform 34 spaced above wall 16 and extending away from terminal 30. A flexible, electrically conductive movable contact arm 36 formed of material having good spring characteristics such as beryllium copper or the like is mounted on platform 34 in cantilever fashion by suitable means such as rivet 38. A movable contact 40 of suitable contact material is mounted on the free distal end of arm 36 in any conventional manner such as by welding and is adapted to move into and out of circuit engagement with a stationary contact 42 mounted on a shelf 44 of terminal 30 received on wall 16. Contact 42 formed of suitable contact material is shown as an inlaid portion of shell 44 however the contact could be separately attached if desired. A dimple 46 is preferably formed in movable arm 36 provide more uniform motion transfer characteristics from motion transfer pin 48 to be described below.

A metallic disc element support and motion transfer pin guide member 50 is received on the flat top surface 20 of base 12 and comprises a generally circular bottom wall 52 with a centrally disposed downwardly extending wall 54 forming a bore adapted to slidingly receive motion transfer pin 48. An annular force reaction ridge 56 is formed in wall 52 and is adapted to engage a snap acting disc as described below. Support and guide member 50 is also provided with an upstanding wall 58 which slidingly receives a pressure converter 60 formed with a disc receiving seat 62 in its lower surface adjacent the outer periphery of the converter. A snap acting disc 64 shown in FIG. 1 in its normal downwardly facing convex configuration has its outer peripheral edge received on seat 62. Converter 60 is recessed at 66 to permit disc 64 to snap through to its opposite downwardly facing concave configuration upon the occurrence of preselected conditions. Disc 64 is formed of a metal spring material such as stainless steel or a thermostat bimetal or the like which is adapted to move between original and inverted configurations in response to the occurrence of selected pressure or temperature conditions or the like in conventional manner. In order to provide more consistent calibration of the device, it is preferred to interpose a film 68 of Kapton or the like between disc 64 and seat 62.

A metallic pressure divider and support ring 70 is placed on the top edge of wall 58 with a flexible diaphragm 72 of Teflon coated Kapton or the like disposed over the opening in ring 70.

A cup shaped metallic shell 74 has a top end wall 76 and is preferably deep drawn to form a depending side wall 78 with a gasket receiving channel 80 formed in top wall 76 adjacent the outer periphery of the shell. An annular stop surface 82 is also formed in top wall 76 for a purpose to be described below. A gasket 84 such as a suitable, compressable "O" ring is placed in channel 84 and shell 74 is placed over diaphragm 72, ring 70 and member 50 and is drawn against these elements to compress gasket 84 a selected amount determined by the location of stop surface 82. The lower distal end 86 of depending wall 78 is crimped over a lower surface 88 of base 12. This crimp can be formed entirely around the circumference of base 12, or as shown in FIG. 1 the crimp may be castellated so that spaced tab portions 90 clamp surface 88 while the remainder of distal end 86 forms a guide surface 92 against which a snap ring for mounting the switch can be placed without placing undue torque on the snap ring. Gasket 84 by being compressed to an accurately controllable degree directly through metallic ring 70 and metallic wall 58 provides a very effective gas tight seal to prevent leakage of fluid being monitored. When the crimp of the shell is castellated, it is preferred to include an "O" ring gasket 94 in a groove formed in the outer periphery of side wall 18 to provide an effective salt spray and moisture seal for the switch components.

In assembling the switch, platform 34 is bent downwardly to provide a selected contact opening force. Support and guide member 50 is placed on surface 20 and the distance between dimple 46 with the contact closed to the lower surface of disc 64 in its normal downwardly convex configuration is measured so that pin 48 formed of suitable material such as glass, plastic or ceramic of a precise, selected length can be provided to obtain desired operating characteristics. Ceramic is particularly useful in that slightly overlong pins can easily be ground to the correct length to compensate in variations in manufacturing, for example slight variations in the thickness which may exist from batch to batch.

A suitable orifice 96 may provided in top wall 76 so that switch 10 can be placed in position to monitor the pressure of a fluid at a desired location. Thus with a first fluid pressure applied to diaphragm 72 the disc element 64 is normally disposed on the configuration shown in FIG. 1 with the contacts maintained in the closed, circuit engaging state through the force exerted on arm 36 via disc 64. Pressure converter 60, aligned with the opening in ring support 70 is movable in response to movement of the diaphragm as the diaphragm moves in response to variation in fluid pressures applied to the diaphragm through orifice 96. The dished disc element is positioned to be engaged on one side by the pressure converter, and reaction ridge means 56 are arranged to engage an opposite side of the dished disc element. When the applied fluid pressure is increased to the selected actuating pressure of the switch 10, the disc element 64 moves with snap action to an inverted dished configuration for permitting contact arm 36 to move way from stationary contact 42. Overtravel of disc 64 is prevented by a continuous annular surface 69 formed on converter 60.

Subsequently, when the applied fluid pressure is lowered to a selected reset pressure level for the switch 10, movement of the diaphragm 72 allows the pressure converter 60 to reduce the force on the snap acting element 64 so that the element returns with snap action to the configuration shown in FIG. 1.

The support and guide member 50, as shown in FIG. 1 may conveniently be stamped out of a suitable metallic piece and combines the functions of acting as a guide for the pressure converter and the motion transfer pin, a disc support, an overtravel preventing means and a structural member to transfer clamping force to provide an effective gas tight seal.

Device 10.1 shown in FIG. 2 is a normally open switch in which the disc force is used to maintain the contacts in an open state. Generally it is preferred to use the disc to provide contact closing forces but in certain applications it may be preferred to ensure that even momentary contact closure is prevented due to vibration or the like. Thus stationary contact 42.1 formed on terminal 30.1 is spaced above wall 16 of base 14 and movable contact 40.1 is mounted on the opposite side of movable contact arm 36.1 compared to the FIG. 1 structure. A dielectric layer 43 is preferably placed on top of shelf 31 of terminal 30.1 to prevent contact arm 36.1 from making electrical contact with shelf 31.

Additionally, a second layer 68.1 of friction reducing plastic material of Kapton or the like is disposed on the lower side of disc 64. Placement of layers 68 and 68.1 on opposite sides of disc 64 provides improved consistency of calibration of the switch and can be used advantageously whenever the pressure converter is employed. In other respects the structure shown in FIG. 2 and in subsequent figures showing parts which are common and are shown and described in relation to FIG. 1 will not be repeated.

Figure 3:
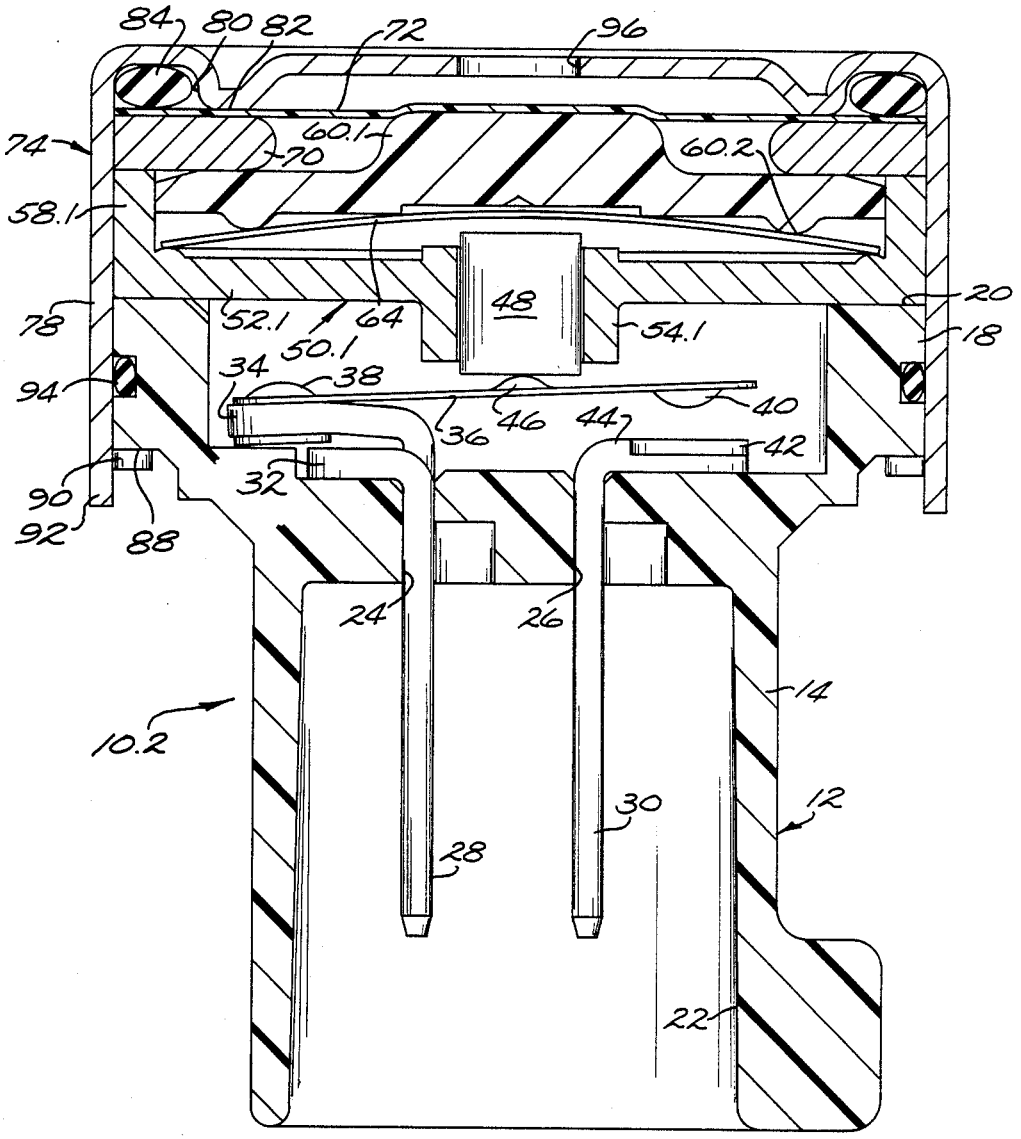
FIG. 3 is a sectional view along the longitudinal axis of a normally open switch made in accordance with a second embodiment of this invention.

Switch 10.2 shown in FIG. 3 utilizes a modified disc support and guide member 50.1 and pressure converter 60.1. The FIG. 3 switch provides a normally open switch similar to FIG. 2 however it also provides contacts closure force by the disc. Disc support and guide member 50.1 is formed with a disc seat 50.2 adjacent its outer periphery while a force applying annular ridge 60.2 is formed on the bottom surface of pressure converter 60.1. Although not shown, a friction reducing layer can be disposed on one or both sides of disc 64 as in the FIGS. 1, 2 constructions.

It will be seen that an increase in pressure applied to diaphragm 72 to the actuation level will place a force on disc 64 through force applying ridge 60.2 while seat 50.2 applies a reaction to cause the disc to snap from the downwardly concave configuration shown in FIG. 3 to a downwardly convex configuration thereby transferring motion through pin 48 to movable arm 36 to cause contact 40 to engage stationary contact 42 with a force provided by disc 64. As in the previous embodiment, when the applied pressure drops below a selected reset value disc 64 will snap back to the configuration shown in FIG. 3 and allow the contacts to open through the bias on arm 36 caused by the position of platform 34.

Support and guide member 50.1, as in the FIGS. 1 and 2 embodiment combines the several functions of serving as guide surface 58.1 and 54.1 respectively for pressure converter 60.1 and motion transfer pin 48, as a disc support, an overtravel preventing means by a continuous surface 50.3 and as a structural member 58.1 to transfer clamping force to provide an effective gas tight seal. As shown in FIG. 3 member 50.1 is formed by machining to provide an extremely accurate and consistent placement of the component parts of the switch relative to one another to thereby introduce fewer variations in spacing from device to device and permit a smaller grouping of devices in a selected narrow calibration range. That is, wall 58.1 is formed with a precise right angle with bottom wall 52.1 so that it is received on flat surface 20 of base 12 with the same dimensional relationship from one device to another whereas in the stamped support and guide member some variations in dimensional relationships from one device to another may occur as the stamping tools start to wear, etc.

Figure 4:
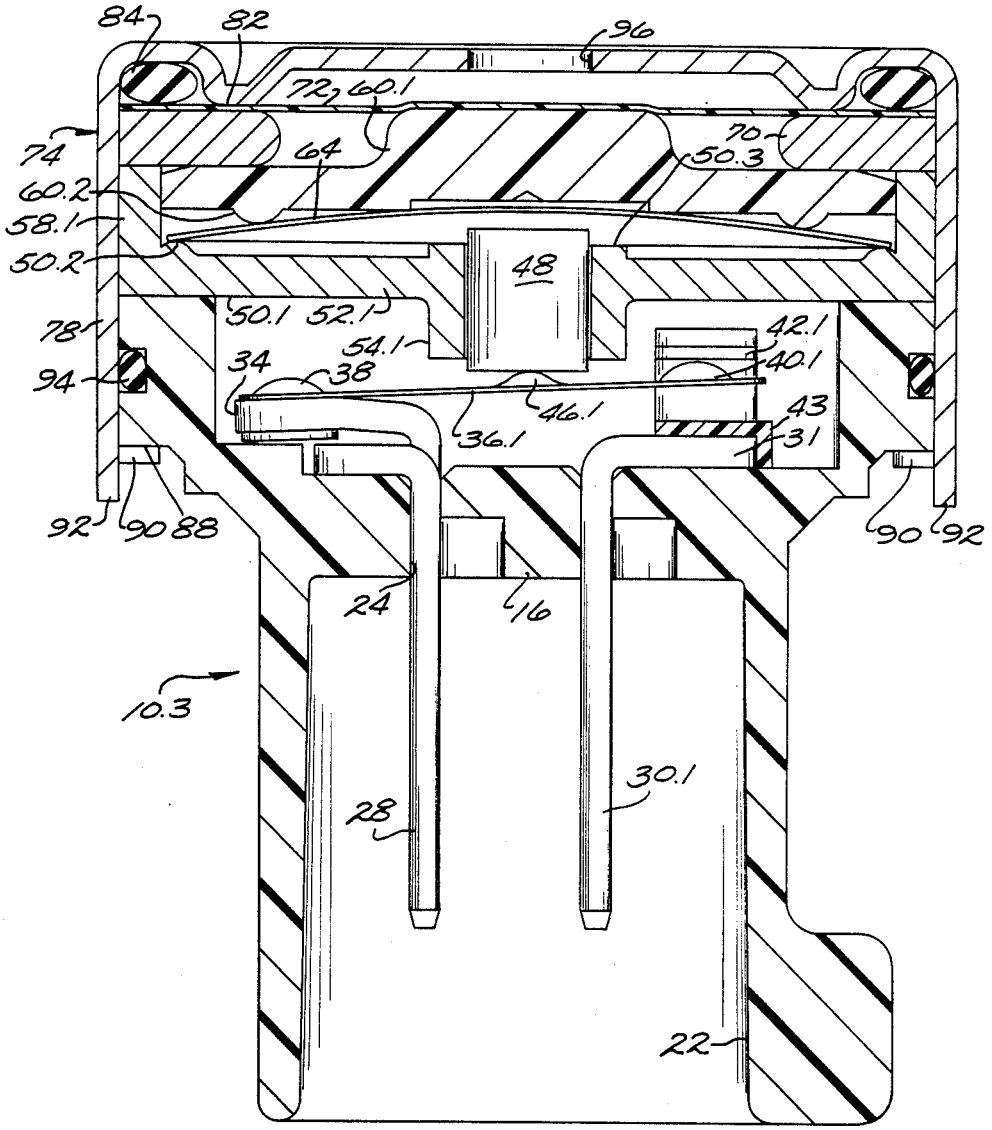
FIG. 4 is a sectional view similar to FIG. 3 of a normally closed switch otherwise the same as the switch shown in FIG. 3.

The switch of FIG. 4 is the same as that of FIG. 3 except that it is a normally closed switch with the disc being used to provide a positive force to prevent contact closure when in the actuated condition. As in FIG. 2 stationary contact 42.1 is spaced above bottom wall 16 with contact 40.1 mounted on the opposite side of movable contact arm 36.1 compared to the structure of FIG. 3. Dielectric layer 43 is placed on shelf 31 of terminal 30.1 the same reason as in the FIG. 2 structure.

An increase in applied pressure to a selected actuation pressure will cause disc 64 to snap from the downwardly facing concave configuration shown in FIG. 4 to its opposite downwardly facing convex configuration transferring motion to arm 36.1 through pin 48 to thereby force contact 40.1 away from stationary contact 42.1 and maintain it away from the stationary contact with a positive force applied by disc 64. When the applied pressure drops below the reset value, the disc will be allowed to snap back to the FIG. 4 configuration and the contacts will close through the bias applied to arm 36.1 by platform 34.

Figure 5:
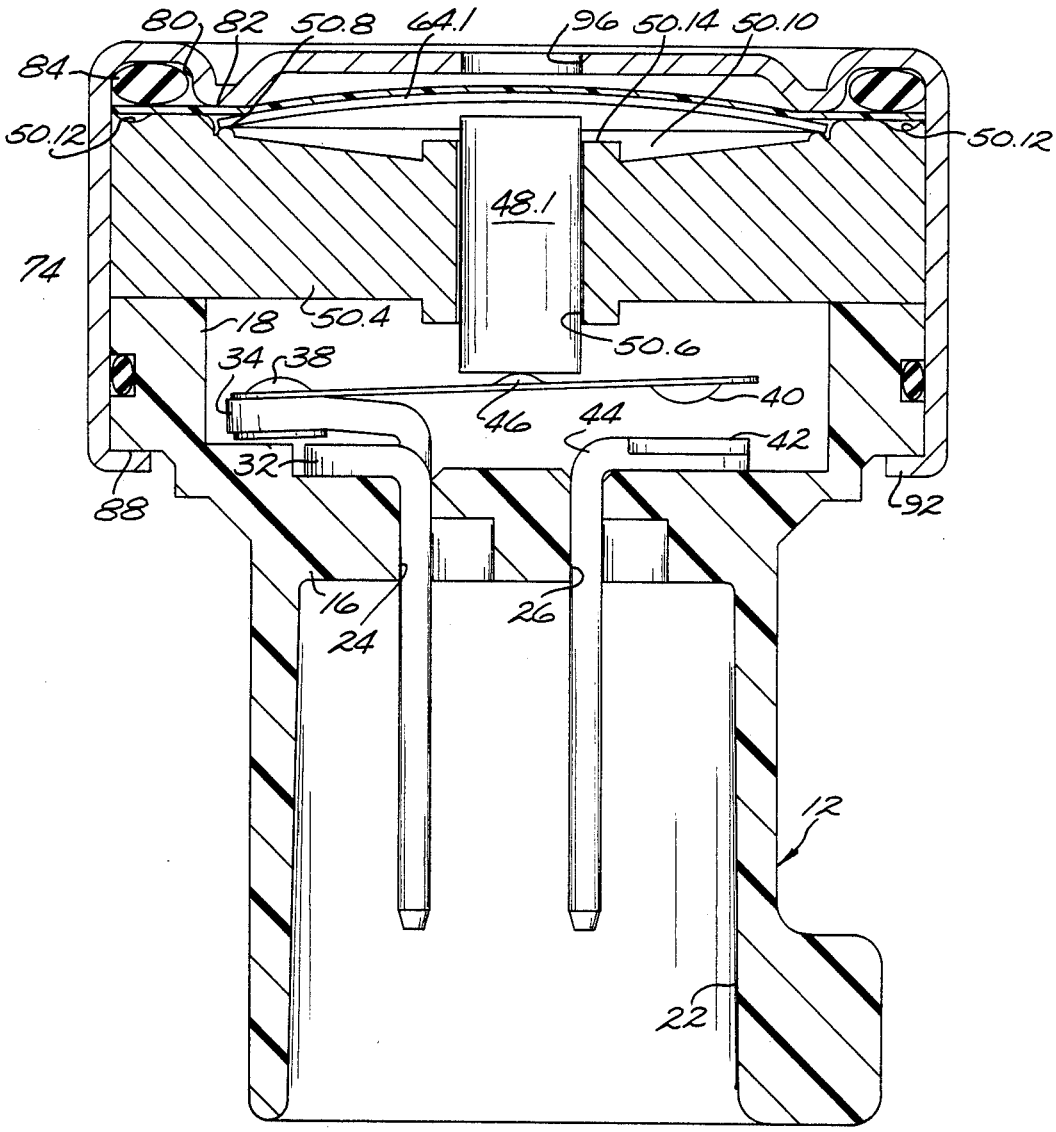
FIG. 5 is a sectional view along the longitudinal axis of a normally open switch made in accordance with a third embodiment of the invention.

FIG. 5 depicts an embodiment particularly suitable for use with lower pressures where a pressure converter is not required. In this embodiment a flat metallic disc support and pin guide member 50.4 is formed which can conveniently be used with the same cup shaped shell 74 and gasket 84. Member 50.4 is formed with a centrally disposed bore 50.6 to serve as a guide for a motion transfer pin 48.1. The height of member 50.4 is selected to be the same as the combination of support ring 70 and the disc support and guide member 50 and 50.1 of the previous embodiments. Disc support and guide member 50.4 is formed with a disc seat 50.8 in a recess 50.10 formed in the top surface of member 50.4. It will be noted that the disc 64.1 extends beneath surface 82 of shell 74 so that surface 82 cannot be relied on to prevent excessive compression of gasket 84 as in the previous embodiments. This is caused by the need for maximizing motion transfer pin travel. That is, a disc having a smaller diameter so that recess 50.10 would not be directly beneath surface 82 would provide less pin travel. In order to avoid the possibility of the gasket from squeezing beneath surface 82 and thereby affecting the efficacy of the seal a recessed area 50.12 having a smooth curve is formed in the upper surface of member 50.4 immediately adjacent the outer periphery thereof. Thus an effective seal can be obtained by placing shell 74 with gasket 84 received in channel 80 over support and guide member 50.4 and wall 18 of base 12 and applying a selected force to compress gasket 84 and then crimp wall portion 78 onto lower surface 88 of base 12. As shown in this figure, the crimp is placed completely around shell 74 by rolling over distal end portion 92. With a crimp completely around base 12 the need for a gasket in the outer surface of wall 18 is obviated. In general, a 360 degree crimp is employed when the switch is mounted utilizing a port fitting such as that described below in connection with FIGS. 6 and 7. When the switch is mounted by means of a snap ring cooperating with a groove in a switch receiving well, the castellated crimp shown in FIGS. 1–4 is preferred.

Support and guide member 50.4 has a continuous overtravel limit surface 50.14 disposed in the recessed area 50.10 to limit travel of disc 64.1 and avoid deleterious effects on its calibration which could result from either an absence of a stop surface or a discontinuous surface which could allow twisting of the disc.

The use of a metal disc support, particularly as shown in FIG. 5 rather than prior art plastic supports avoid the problem of having the disc digging into the plastic upon continued operation of the switch and eventually dislodging plastic particles which could become wedged between the disc and its support upsetting designed dimensional relationships. In addition, the relatively massive disc support of FIG. 5 serves as a heat sink which can provide greater stability of calibration in some cases, for example where the switch is operating on fluid which is subject to temperature changed. The heat sink would tend to stabilize the temperature of the disc and therefore its calibration since the modulus of elasticity varies with temperature.

It will be appreciated that the structure of FIG. 5 could be used as either a temperature or a pressure responsive device or both. That is, if disc 64.1 is formed of bimetal, the switch can be utilized to sense temperature variations of a heat source and be adapted to actuate from the configuration shown to its opposite configuration upon selected temperature conditions. The FIG. 5 switch as well as the other embodiments described above, could also be used to monitor both temperature and pressure by using a bimetal disc and be adapted to actuate upon a combination of selected fluid pressure and temperature conditions. If the disc is formed of a monometal, then it can be used solely to monitor fluid pressure.

Figure 6:
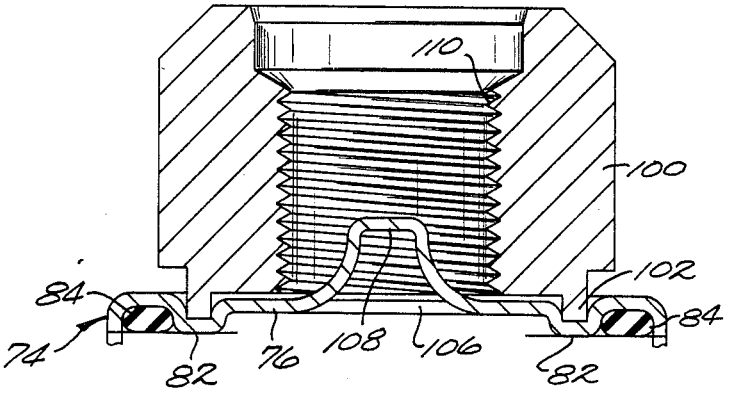
FIG. 6 is a sectional view along the longitudinal axis of a combination port fitting and valve deflator useful with the above embodiments.
Figure 7:
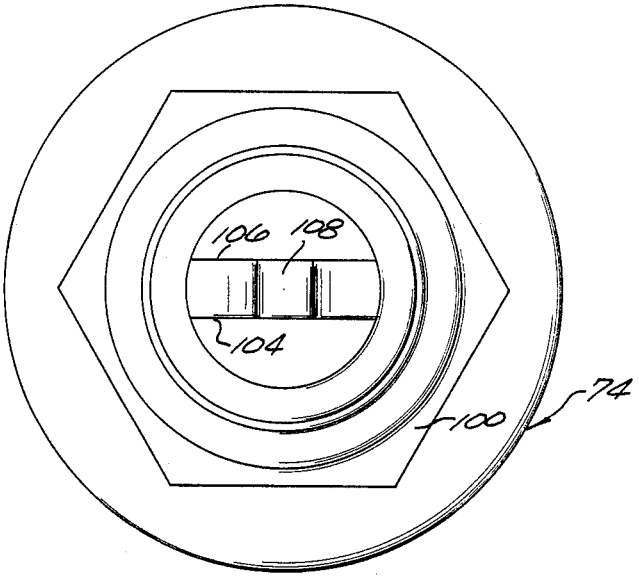
FIG. 7 is a top plan view of the FIG. 6 device.

FIG. 6 shows a port fitting 100 which is provided with an automatic valve deflator in a simple yet effective manner and which can be used with any of the above embodiments. Port fitting 100 is hermetically attached to cap 74 as by welding thereto completely around the periphery of the port fitting. As seen in FIG. 6 a circular flange 102 fits into the groove formed on the opposite side of stop surface 82 of top wall 76. Top wall 76 is lanced forming parallel slits 104, 106 and surface portion 108 is drawn upwardly displacing it above wall 76 a selected distance. As port fitting 100, provided with a threaded bore 110 is screwed onto a fitting having a needle type valve member, surface 108 is adapted to contact the valve member and depress it as the port fitting is screwed into place thereby automatically opening the valve.

It should be understood that although particular embodiments of the condition responsive switch of this have been described by way of illustrating the invention, the invention includes all modifications and equivalents of the disclosed embodiments falling within the scope of the appended claims.

What is claimed is:

1. A condition responsive switch having first and second electrical contacts mounted on a base member, the contacts movable relative to one another into and out of circuit engagement, the base provided with an upstanding annular wall with a top wall surface and a lower wall surface, a metallic disc support and motion transfer pin guide member having a bottom and a top received on the base, a condition responsive disc received on the support and guide member, the disc movable between convex and concave configurations upon the occurrence of selected conditions, a bore extending through the support and guide member from the top to the bottom, a diaphragm received on top of the support member and extending over the disk, a metallic cup shaped shell having a closed end wall with an annular gasket receiving channel formed in the outer peripheral portion of the closed end wall aligned with the outer periphery of the diaphragm, the cup having a downwardly depending wall with a free distal end portion, an annular gasket received in the channel, the cup shaped shell received over the support and guide member with the free distal end portion of the depending wall crimped onto the lower wall surface of the base to compress the gasket against the diaphragm to obtain an improved gas tight seal, the metallic disc support and motion transfer pin guide member being generally flat and having a curved annular recess formed in the top adjacent the outer periphery of said member whereby the diaphragm is forced into the annular recess by flexing the gasket, a motion transfer member slidingly received in the bore of the support and guide member and adapted to transfer motion from the condition responsive disc to the electrical contact members to cause relative motion of the contact members, and a fluid pressure receiving orifice formed in the closed end of the cup shaped shell.

2. A condition responsive switch according to claim 1 in which the end wall of the shell is formed with a stop surface adjacent the gasket receiving channel to limit the amount that the gasket can be compressed.

3. A condition responsive switch according to claim 1 in which a continuous annular overtravel stop surface is formed on the disc support and motion transfer pin guide member and so disposed in the path of the disk to prevent overtravel and overstressing of the disc.

4. A condition responsive switch having first and second electrical contacts mounted on a base member, the contacts movable relative to one another into and out of circuit engagement, the base provided with an upstanding annular wall with a top wall surface and a lower wall surface, a disc support and motion transfer pin guide member having a bottom and a top received on the base, a condition condition responsive disc received on the support and guide member, the disc movable between convex and concave configurations upon the occurrence of selected conditions, a bore extending through the support and guide member from the top to the bottom, a diaphragm received on top of the support member and extending over the disk, a metallic cup shaped shell having a closed end wall with an annular gasket receiving channel formed in the outer peripheral portion of the closed end wall aligned with the outer periphery of the diaphragm, the cup having a downwardly depending wall with a free distal end portion, an annular gasket received in the channel, the cup shaped shell received over the support and guide member with spaced portions of the free distal end portion of the depending wall of the shell crimped onto the lower wall surface of the base to compress the gasket against the diaphragm to obtain an improved gas tight seal, an annular groove formed in the outer portion of the upstanding wall of the base and a gasket disposed in the annular groove to provide a moisture seal, a motion transfer member slidingly received in the bore of the support and guide member and adapted to transfer motion from the condition responsive disc to the electrical contact members to cause relative motion of the contact members, and a fluid pressure receiving orifice formed in the closed end of the cup shaped shell.

5. A condition responsive switch according to claim 4 in which a continuous annular overtravel stop surface is formed on the disc support and motion transfer pin guide member and so disposed in the path of the disk to prevent overtravel and overstressing of the disc.

6. A condition responsive switch according to claim 4 in which the end wall of the shell is formed with a stop surface adjacent the gasket receiving channel to limit the amount that the gasket can be compressed.

7. A condition responsive switch having first and second electrical contacts mounted on a base member, the contacts movable relative to one another into and out of circuit engagement, the base provided with an upstanding annular wall with a top wall surface and a lower wall surface, a disc support and motion transfer pin guide member having a bottom and a top received on the base, a condition responsive disc received on the support and guide member, the disc movable between convex and concave configurations upon the occurrence of selected conditions, a bore extending through the support and guide member from the top to the bottom, a diaphragm receied on top of the support member and extending over the disk, a metallic cup shaped shell having a closed end wall with an annular gasket receiving channel formed in the outer peripheral portion of the closed end wall aligned with the outer periphery of the diaphragm, the cup having a downwardly depending wall with a free distal end portion, an annular gasket received in the channel, the cup shaped shell received over the support and guide member with the free distal end portion of the depending wall crimped onto the lower wall surface of the base to compress the gasket against the diaphragm to obtain an improved gas tight seal, a motion transfer member slidingly received in the bore of the support and guide member and adapted to transfer motion from the condition responsive disc to the electrical contact members to cause relative motion of the contact members, a fluid pressure receiving orifice formed in the closed end of the cup shaped shell and a port fitting having an axially extending bore sealingly attached to the closed end wall of the cup shaped member circumscribing the fluid pressure receiving orifice, the fluid pressure receiving orifice being formed by a pair of slits extending through the closed end of the cup shaped shell with the wall between the slits displaced a selected distance into the axially extending bore to serve as an automatic deflator element integrally formed with the closed end wall of the cup shaped shell.

8. A condition responsive switch according to claim 7 in which a continuous annular overtravel stop surface is formed on the disc support and motion transfer pin guide member and so disposed in the path of the disk to prevent overtravel and overstressing of the disc.

9. A condition responsive switch according to claim 7 in which the end wall of the shell is formed with a stop surface adjacent the gasket receiving channel to limit the amount that the gasket can be compressed.

* * * * *